US007165769B2

(12) United States Patent
Crenshaw et al.

(10) Patent No.: US 7,165,769 B2
(45) Date of Patent: Jan. 23, 2007

(54) SYSTEMS AND METHODS FOR CARD GAMES THAT SIMULATE NON-CARD CASINO TABLE GAMES

(75) Inventors: Michael P. Crenshaw, Temecula, CA (US); David F. Fendrick, Temecula, CA (US); Jerome H. Turk, Del Mar, CA (US)

(73) Assignee: The Pala Band of Mission Indians, Pala, CA (US)

( * ) Notice: Subject to any disclaimer, the term of this patent is extended or adjusted under 35 U.S.C. 154(b) by 0 days.

(21) Appl. No.: 10/641,694

(22) Filed: Aug. 15, 2003

(65) Prior Publication Data

US 2004/0164492 A1 Aug. 26, 2004

(51) Int. Cl.
*A63F 5/00* (2006.01)
*A63F 9/04* (2006.01)

(52) U.S. Cl. ..... 273/274; 273/309; 273/292; 273/138.1; 273/138.2; 273/142 R; 273/142 E; 273/146

(58) Field of Classification Search ..... 273/274, 273/309, 292, 138.1, 138.2, 146
See application file for complete search history.

(56) References Cited

U.S. PATENT DOCUMENTS

| | | | | |
|---|---|---|---|---|
| 645,961 | A | | 3/1900 | Kingwill |
| 1,236,094 | A | | 8/1917 | Lloyd |
| D59,761 | S | | 11/1921 | McCarthy |
| D89,035 | S | | 1/1933 | Chalk |
| 2,457,020 | A | | 12/1948 | Whitney |
| 2,560,187 | A | | 7/1951 | Post |
| 4,149,728 | A | | 4/1979 | Thompson |
| 4,355,812 | A | | 10/1982 | McCullough |
| 4,443,012 | A | | 4/1984 | Makovic et al. |
| 4,746,126 | A | | 5/1988 | Angileri |
| 5,098,107 | A | | 3/1992 | Boylan et al. |
| 5,100,139 | A | * | 3/1992 | Di Bella ..... 273/292 |
| 5,551,700 | A | | 9/1996 | Druce et al. |
| 5,676,375 | A | | 10/1997 | Pirouzkhah |
| 5,775,993 | A | | 7/1998 | Fentz et al. |
| 5,904,353 | A | | 5/1999 | Aldridge |
| 5,964,463 | A | | 10/1999 | Moore, Jr. |
| 6,213,876 | B1 | | 4/2001 | Moore, Jr. |
| 6,302,395 | B1 | | 10/2001 | Astaneha |
| 6,536,767 | B1 | * | 3/2003 | Keller ..... 273/292 |
| 6,688,597 | B2 | * | 2/2004 | Jones ..... 273/274 |
| 2001/0015529 | A1 | * | 8/2001 | Allen ..... 273/292 |
| 2001/0034264 | A1 | | 10/2001 | Berman et al. |
| 2002/0043766 | A1 | * | 4/2002 | Berman ..... 273/292 |
| 2003/0032471 | A1 | | 2/2003 | Darder |
| 2003/0071415 | A1 | * | 4/2003 | Huard et al. ..... 273/274 |

OTHER PUBLICATIONS

Harrah's Rincon Casino & Resort, Payouts and Odds Table Chart.
Explanation of Rincon Craps Game.

* cited by examiner

*Primary Examiner*—Benjamin Layno
(74) *Attorney, Agent, or Firm*—Morriss O'Bryant Compagni

(57) ABSTRACT

Methods and systems for conducting gaming activities are disclosed. In one method, wagers are placed on a game and cards are dispensed. An indicia of a play card is used to determine an outcome of the game. A feature bet is included, wherein if the indicia of the play card is a predetermined indicia, an indicia of the second card is identified. If a predetermined indicia on the second card is identified, a feature bet payoff is made to players that wagered on the feature bet. A method and system for a roulette game are also disclosed. A roulette wheel is used to determine which card of a deck of cards determines the outcome of the roulette game. A craps game system and method are further described. Dice are used to determine which card of a deck of cards determines the outcome of the craps game.

29 Claims, 6 Drawing Sheets

SYSTEMS AND METHODS FOR CARD GAMES THAT SIMULATE NON-CARD CASINO TABLE GAMES

TECHNICAL FIELD

The present invention relates generally to gaming systems and methods and, more particularly, to casino gaming activities using cards.

BACKGROUND

Casino table games are popular attractions at gaming establishments. However, agencies in some localities, such as state gaming commissions, may limit the types of gaming activities that may be conducted in that locality. For instance, in some localities, only card-based games of chance may be offered as table games and non-card table games, such as craps, roulette, wheel of fortune and so forth may not be offered.

Attempts have been made to adapt non-card casino table games by changing the way in which the game of chance is conducted in order to allow it to be offered. Some of these attempts include simulating a non-card casino table game with a card-based table game. For example, U.S. Published Patent Application US2003/0032471 to Darder discloses a gaming table that appears similar to a traditional craps table for the simulation of a game of craps. To facilitate play of the simulated craps game, additional elements are added to the craps table. In Darder, cards are drawn from a deck including cards numbered from ace through six and including additional indicia, such as the four traditional suits, i.e., hearts, diamonds, spades and clubs. Drawn cards are replaced by jokers, allowing similar odds to be maintained on different draws, and additional bets are available based on the presence of the joker cards. Other additional bets may be placed on the occurrence of the additional indicia, such as the suit, when the cards are drawn.

However, by including jokers and the additional indicia on the cards, and providing extra bets, the simulated craps game is made more complex and moved farther away from the traditional craps game that it attempts to emulate. A player accustomed to the traditional non-card craps game will need to become familiarized with the additional bets and complexities of the simulated craps game in order to play. Thus, new players may be discouraged by the additional bets and complexities, and not have interest in the simulated game.

U.S. Pat. No. 5,904,353 to Aldridge describes a deck of thirty-six playing cards representing every roll combination of two six-sided dice, wherein each card displays the two dice on the face of each card in different color to distinguish every possible combination of the two dice. A method of playing a game with the cards is also disclosed. Further, U.S. Design Pat. No. 59,761 to McCarthy similarly discloses a deck of cards having thirty-six cards, wherein the cards represent each of the possible combinations when two six-sided dice are rolled. However, merely drawing a card to represent an outcome of a game of chance lacks the interactive action of a conventional casino game and may cause players to lose interest in the game.

BRIEF SUMMARY OF THE INVENTION

In one exemplary embodiment, the present invention comprises a method for conducting a gaming activity. The method includes offering at least one player an opportunity to place a wager on a table game, wherein an additional wager includes a feature bet not found in the non-card version of the game, while not requiring the player to "relearn" to play the card-based game. The gaming activity further comprises dispensing at least a first card and at least a second card from a deck of cards and designating the at least a first card or the at least a second card as a play card. An indicia on the play card is identified to determine an outcome of the table game that duplicates the non-card version of the game, and may maintain the same odds. If the identified indicia on the play card comprises a first predetermined indicia, any players that wagered on the feature bet may receive a payment based on that bet, or may be qualified for participation in a feature game.

In another exemplary embodiment, a method of conducting a gaming activity including offering at least one player an opportunity to place a wager on a roulette game is disclosed. During play of the roulette game, at least two cards are dispensed from a deck of cards and a roulette wheel is rotated, wherein a ball is dropped into the rotating roulette wheel. Depending on an indicia of the pocket where the ball drops, one of the dispensed cards is designated as a play card. An indicia of the play card is identified to determine an outcome of the roulette game.

Another method of conducting a gaming activity is described in another exemplary embodiment. The gaming activity includes offering at least one player an opportunity to place a wager on a craps game and dispensing at least a first card and at least a second card from a deck of cards. A first die and a second die having faces with distinguishing characteristics thereon are rolled and the distinguishing characteristics are compared, wherein the comparison is used to designate the at least first card or the at least second card as a play card. An outcome of the craps game is determined by identifying an indicia on the play card.

In an additional exemplary embodiment, a system for conducting a roulette game is disclosed. The system includes a table configured for accepting bets on the roulette game. The table comprises indicia and markings of a conventional roulette game, at least one area having an identifying characteristic for receiving at least one card and a betting area for receiving wagers on a feature bet. The system also includes a roulette wheel having pockets, wherein one of the pockets is configured with an identifying characteristic that corresponds to the identifying characteristic of the at least one area for receiving the at least one card. The system may also include a ball configured to fit in the pocket of the roulette wheel and a deck of cards for determining an outcome of the roulette game.

A system for conducting a craps game is disclosed in another exemplary embodiment. The system includes a table configured for accepting bets on the craps game. The table also includes indicia and markings of a conventional craps game, a betting area for receiving wagers on a feature bet and an area for receiving at least one card, wherein the area for receiving the at least one card has an identifying characteristic. The system also includes a six-sided die, wherein a face of the die has an identifying characteristic that corresponds to the identifying characteristic of the area for receiving the card. The system also includes a deck of cards for determining an outcome of the craps game.

DETAILED DESCRIPTION

Generally, the present invention includes new and enhanced methods of conducting a gaming activity. In the exemplary embodiments, a game of chance is played with a deck of cards, wherein a card or cards are randomly selected to arrive at the outcome of the game of chance. While the present invention is described in terms of certain specific, exemplary embodiments, the specific details of the exemplary embodiments are not meant to be limiting. For instance, while the exemplary embodiments are described in relation to table gaming activities, the exemplary embodiments may be conducted using electronic gaming devices employing random number generators and/or central processing units, with computer generated depictions of the cards or other game elements. Various combinations or modifications of the exemplary embodiments may be made without departing from the scope of the invention.

Figure 1:
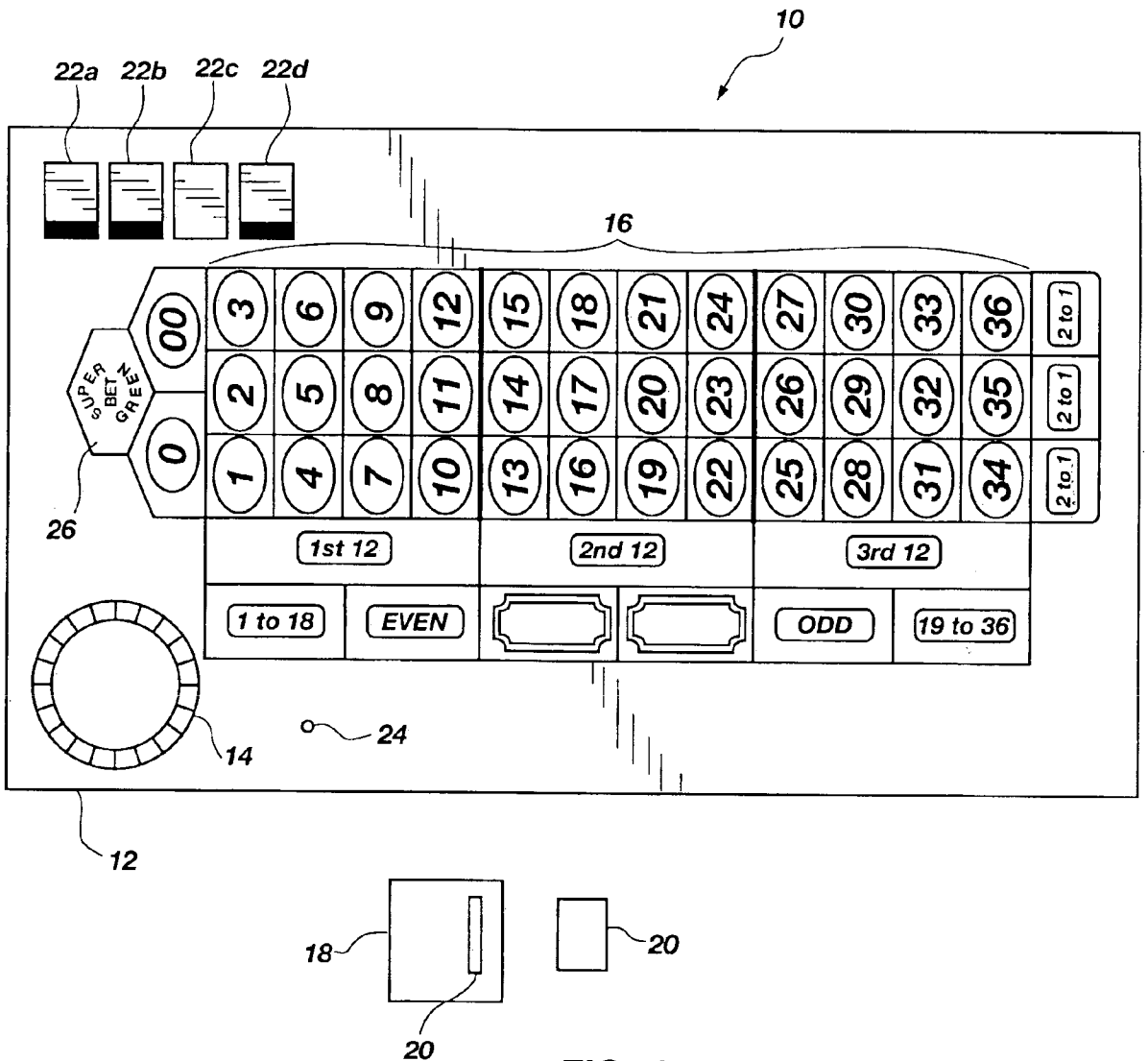
FIG. 1 is a schematic of a gaming system for playing roulette with cards.

Referring now to FIG. 1, there is illustrated one embodiment of a gaming system for conducting a card-based roulette game generally at 10. The roulette gaming system 10 includes a roulette table 12 having a substantially conventional roulette layout for conducting the card-based roulette game. The roulette table 12 includes a roulette wheel 14 and indicia 16 for placing bets. It will be appreciated that the depicted layout of the roulette table 12 is illustrative only and any suitable layout may be used. The roulette table 12 is configured with four boxes 22*a*–22*d* (collectively identified as "boxes 22") that are of a size and shape for receiving a card and a betting area 26 for receiving wagers on a feature bet. Each of the four boxes 22*a*–22*d* corresponds to the colors of the roulette wheel 14, i.e., one box 22*a* is dark blue, one box 22*b* is rust brown, one 22*c* box is crème and one box 22*d* is green. The roulette wheel 14 has thirty-eight, substantially equally distributed, pockets without numbers. A ball 24 is also used with the roulette gaming system 10. Thirty-six pockets of the roulette wheel 14 have three different alternating colors, such as twelve dark blue pockets, twelve rust brown pockets and twelve crème pockets. The remaining two pockets are green. The number of colors of the roulette wheel 14 corresponds to the number of boxes 22 on the roulette table 12. Although the exemplary embodiment has been described with specific colors, it will be apparent by those of ordinary skill in the art that any other colors, numbers corresponding to the colors, or combinations of colors may be used. In addition to colors, any symbol or indicia may be used to distinguish between the different pockets of the roulette wheel 14.

Figure 2:
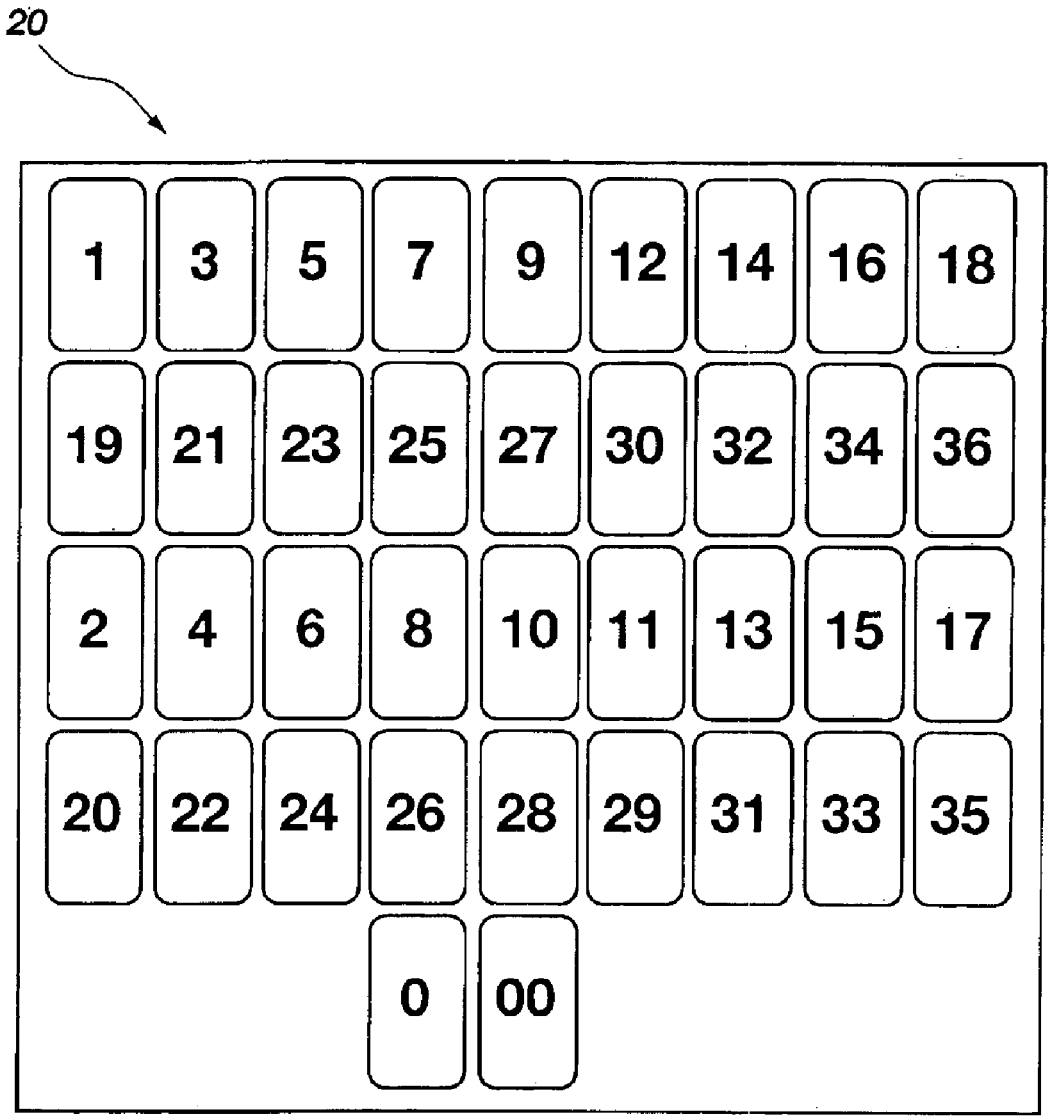
FIG. 2 illustrates the cards used in the roulette gaming system of FIG. 1.

A random card shuffler 18, such as an ACE® brand random-ejection shuffler, a shuffler available from SHUFFLEMASTER of Las Vegas, Nev., or a shuffler configured for use with Three Card Poker, and two decks 20 of cards may also be included in the roulette system 10. In the exemplary embodiment, a thirty-eight card deck 20 is used. FIG. 2 illustrates the faces of one embodiment of a deck 20 of cards, wherein each of the cards has indicia thereon, i.e., 1–36, 0 and 00, that correspond to the indicia 16 of the layout of the roulette table 12.

Play of the roulette game involves players placing bets on the indicia 16 of the roulette layout on the roulette table 12 using known roulette bets. The bets that may be made are substantially the same as those in Las Vegas-style roulette including inside bets and outside bets. Additionally, a feature bet may also be made, as will be described herein. The inside bets include: a one number bet that is a wager on any single number including 1 to 36, 0 or 00 where the bet is made by placing chip(s) directly on a desired number of the indicia 16 of the roulette table 12, the one number bet paying 35-to-1; a two number bet that is a wager on two adjacent numbers of the indicia 16 where the bet is made by placing chip(s) on the line between the two numbers, the two number bet paying 17-to-1; a three number bet that is a wager on a row of three numbers where the bet is made by placing chip(s) on the line of the indicia 16 that separates the inside and outside betting areas, a basket bet can also be made by placing chip(s) on the intersection of 0, 00 and 2 of the indicia 16, the three number bet paying 11-to-1; a four number bet that is a wager on four-numbers where the bet is made by placing chip(s) on a four-number intersection of the indicia 16, the four number bet paying 8-to-1; a five number bet that is a wager on the 0, 00 and first row of three numbers where the bet is made by placing chip(s) between the 0, 00 row and the three-number row on the line that divides the inside and outside betting areas of the indicia 16, the five number bet paying 6-to-1; and a six number bet that is a wager on two three-number rows where the bet is made by placing chip(s) on the line that divides the inside and outside betting areas of the indicia 16, the six number bet paying 5-to-1.

The outside bets include: a twelve number column bet that is a wager on the $1^{st}$ column, the $2^{nd}$ column or the $3^{rd}$ column and is made by placing chip(s) at the end of the roulette table 12 opposite the 0 and 00 of the indicia 16, the twelve number column bet paying 2-to-1; a twelve number numerical bet that is a wager on the $1^{st}$ twelve numbers (1–12), the $2^{nd}$ twelve numbers (13–24) or the $3^{rd}$ twelve numbers (25–36) and is made by placing chip(s) on the appropriate indicia 16 of the roulette table 12, the twelve number numerical bet paying 2-to-1; a red or black bet that is a wager on the eighteen numbers that are black or the eighteen numbers that are red and is made by placing chip(s) on the appropriate diamond of the indicia 16, the red or black bet paying 1-to-1; an odd or even bet that is a wager on the eighteen odd numbers or the eighteen even numbers and is made by placing chip(s) on the appropriate odd or even indicia 16 of the roulette table 12, the odd or even bet paying 1-to-1; and a high or low bet that is a wager on the eighteen low numbers (1–18) or the eighteen high numbers (19–36) and is made by placing chip(s) on the appropriate high or low number indicia 16, the high or low bet paying 1-to-1.

One example of a feature bet includes allowing the players to place a wager that the ball 24 will fall in one of the two green pockets of the roulette wheel 14. If the ball 24 falls into one of two green pockets, the player or players that wagered on the feature bet are qualified for the feature game. The feature game is played by turning over the card in the corresponding green box 22*d* on the roulette table 12. If the card is a green number, i.e., 0 or 00, the player wins the feature bet. The odds of the player winning the featured bet are about 361-to-1 and the payout for a winning bet is 275-to-1, for a theoretical casino advantage of about 23%. In other exemplary embodiments, the payout for the featured bet may be 250-to-1 or 300-to-1. A feature betting area 26 may be located at the top of the indicia 16 of the roulette table 12 or may be located near the roulette wheel 14.

Figure 3:
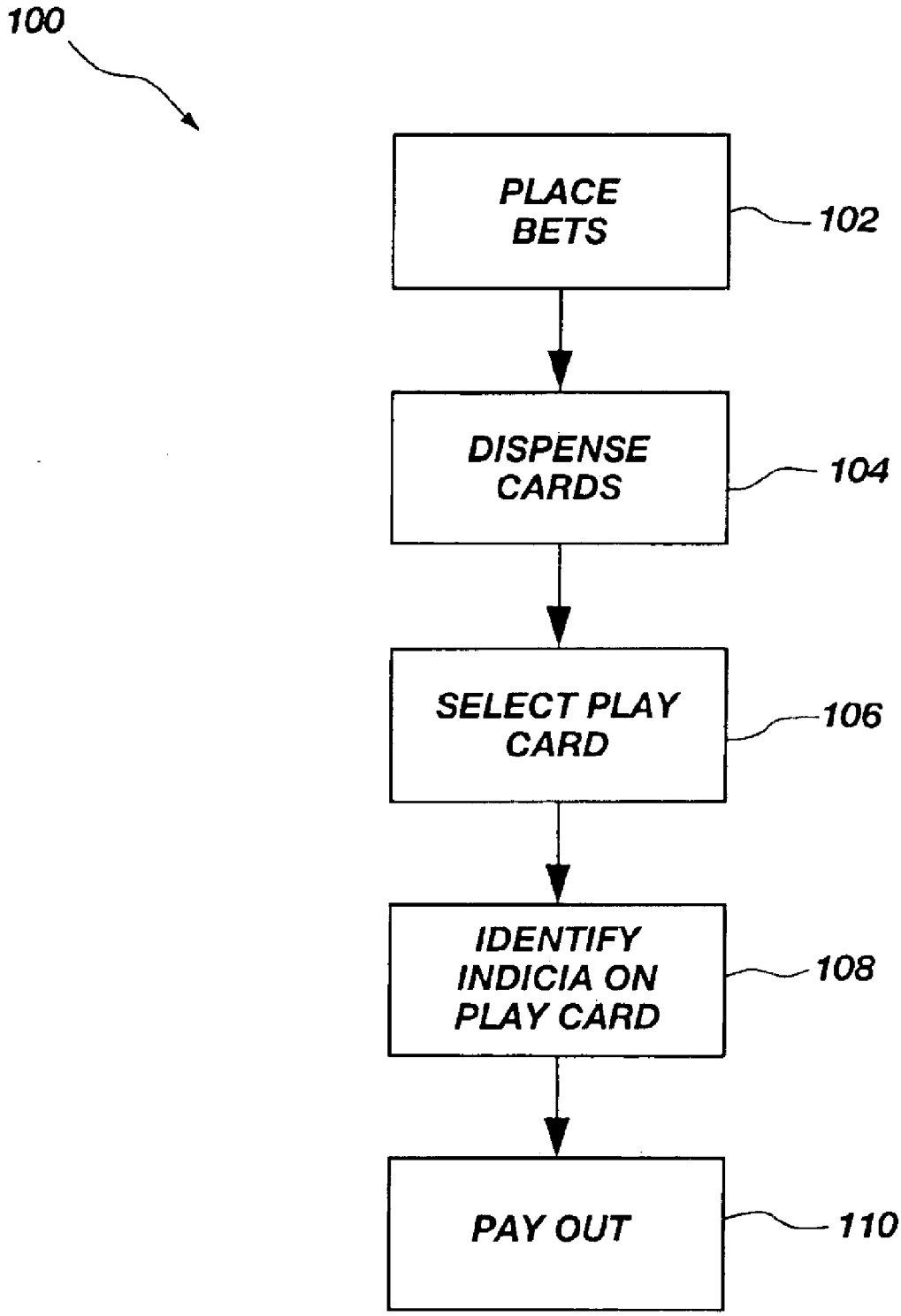
FIG. 3 depicts a flowchart of the roulette game played using the gaming system of FIG. 1.

Referring now to FIG. 3, a flow chart illustrating play of the roulette game is shown generally at 100. Play of the roulette game 100 begins by placing of bets 102. Once the bets have been placed at box 102 by the players, a deck 20 of cards may be shuffled and four cards dispensed at box 104, which may be accomplished using random card shuffler 18 with a deck 20 of cards placed therein. In another exemplary embodiment, the dealer may randomly shuffle and dispense the cards by hand. A dealer places the four randomly-selected cards facedown in each of the four boxes 22*a*–22*d*. Once the four cards are removed from the random card shuffler 18, the thirty-four cards remaining in the random card shuffler 18 may be ejected and placed into a discard holder (not shown), or may be retained in a dispense rack of the random card shuffler 18. The removal of the thirty-four cards from the random card shuffler 18 may trigger the random card shuffler 18 to accept another thirty-eight card deck 20 for another roulette game.

The selection of a play card at box 106 from the four boxes 22*a*–22*d* may be made by placing the spinning ball 24 into the rotating roulette wheel 14. When the ball 24 drops into one of the thirty-eight pockets of the roulette wheel 14, the dealer identifies the indicia on the play card at box 108 by turning over the play card in the box 22*a*–22*d* on the roulette table 12 that corresponds to the color (or other identifying characteristic) of the pocket where the ball 24 dropped. Based on the indicia of the play card, the dealer, or another person associated with the house, then makes payouts at box 110 by sweeping the roulette table 14 of losing bets and paying winners using conventional Las Vegas roulette procedures or conventional double-zero, Nevada-style roulette procedures. The dealer may also check for wagers placed in the feature betting area 26, which in the exemplary embodiment may be referred to as the "Super Green Bet." The drawn cards may then be collected from the roulette table 12 and placed into the discard holder (not shown) with the other discarded thirty-four cards for reuse or discarding. A new roulette game 10 may commence once all payouts are made at box 110.

In other exemplary embodiments, the play card may be selected from the four boxes 22*a*–22*d* using a die or dice, a random number generator, a random selection of a bingo-type balls, by allowing a player to choose one of the four boxes 22*a*–22*d*, or by any other known selection technique. In yet another exemplary embodiment of the roulette system 10, the roulette wheel 14 may be replaced with a random number generator that is configured to randomly select one of the four colors described herein with reference to the roulette wheel 14 using the same odds occurring from use of the roulette wheel 14.

In yet other exemplary embodiments, the roulette game may be played using three boxes 22*a*–22*c* on the roulette table 12 instead of four boxes 22*a*–22*d*. In one embodiment using three boxes 22*a*–22*c*, the 0 and 00 may be removed from the roulette table 12, and the decks 20 of cards would have 36 cards instead of 38 cards since the 0 and 00 are removed. In this embodiment, the roulette game would be played as previously described herein, with the feature bet of betting area 26 being removed from the roulette table 12. In another embodiment using three boxes 22*a*–22*c*, the 0 and 00 are included on the roulette table 12, and the decks 20 of cards would have 38 cards, including the 0 and 00. In this embodiment, the roulette game would be played as previously described herein, including the feature bet 26. It will be apparent by those of ordinary skill in the art that any number of cards and colors may be used. Further, in addition to colors, any other identifying characteristic or indicia may be used.

Figure 4:
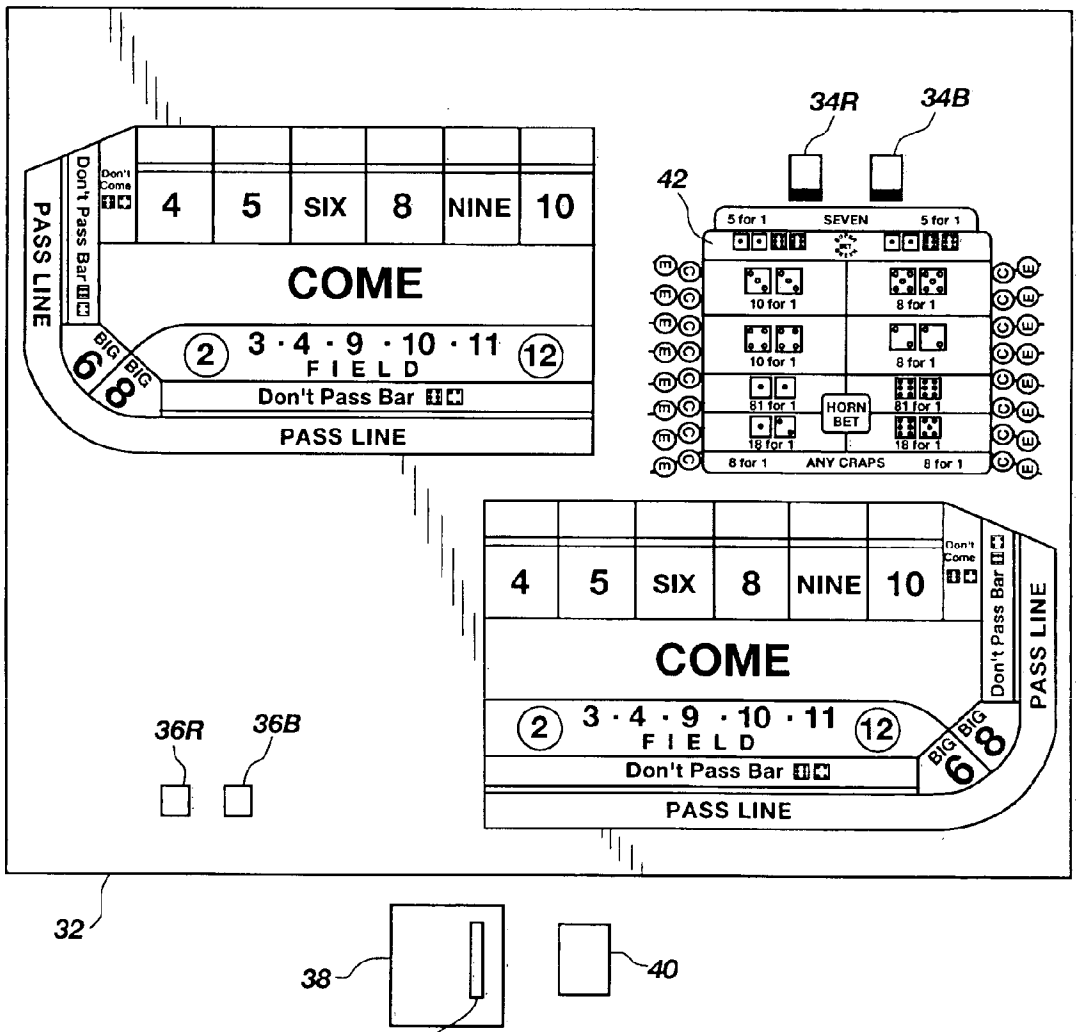
FIG. 4 is a schematic diagram of a gaming system for playing craps with cards.

A craps game played using cards is disclosed in another embodiment of a gaming system of the present invention. Referring to FIG. 4, one embodiment of a craps system for playing a game of craps is shown generally at 30. The craps system 30 includes one embodiment of a craps table 32 with indicia of a layout for a conventional craps game, two boxes 34R (a red box) and 34B (a blue box) for receiving cards, a red six-sided die 36R and a blue six-sided die 36B, a random card shuffler 38 (such as an ACE® brand random-ejection shuffler), two thirty-six card decks 40 and a betting area 42 for receiving wagers on a feature bet. The red die 36R may have one indicia, such as a spot or the number "1" on three sides, and four indicia, such as spots or the number "4," on three sides, and the blue die 36B may have two spots or the number "2" on three sides and three spots or the number "3" on three sides. In this manner, when the red die 36R and the blue die 36B are rolled together, each die has a fifty percent chance of having the highest or lowest number rolled. In addition to the colors blue and red, any other colors, identifying characteristics or indicia may be used to distinguish between the two dice 36. Further, any number of dice having different types of indicia or symbols may be used. For example, a first die having six indicia, such as spots or the number "6" on three sides, and three indicia, such as spots or the number "3," on three sides, and a second die having four spots or the number "4" on three sides and five spots or the number "5" on three sides may be used. In such an embodiment, each of the dice has a fifty percent chance of having the highest or lowest number rolled when the dice are rolled together.

Figure 5:
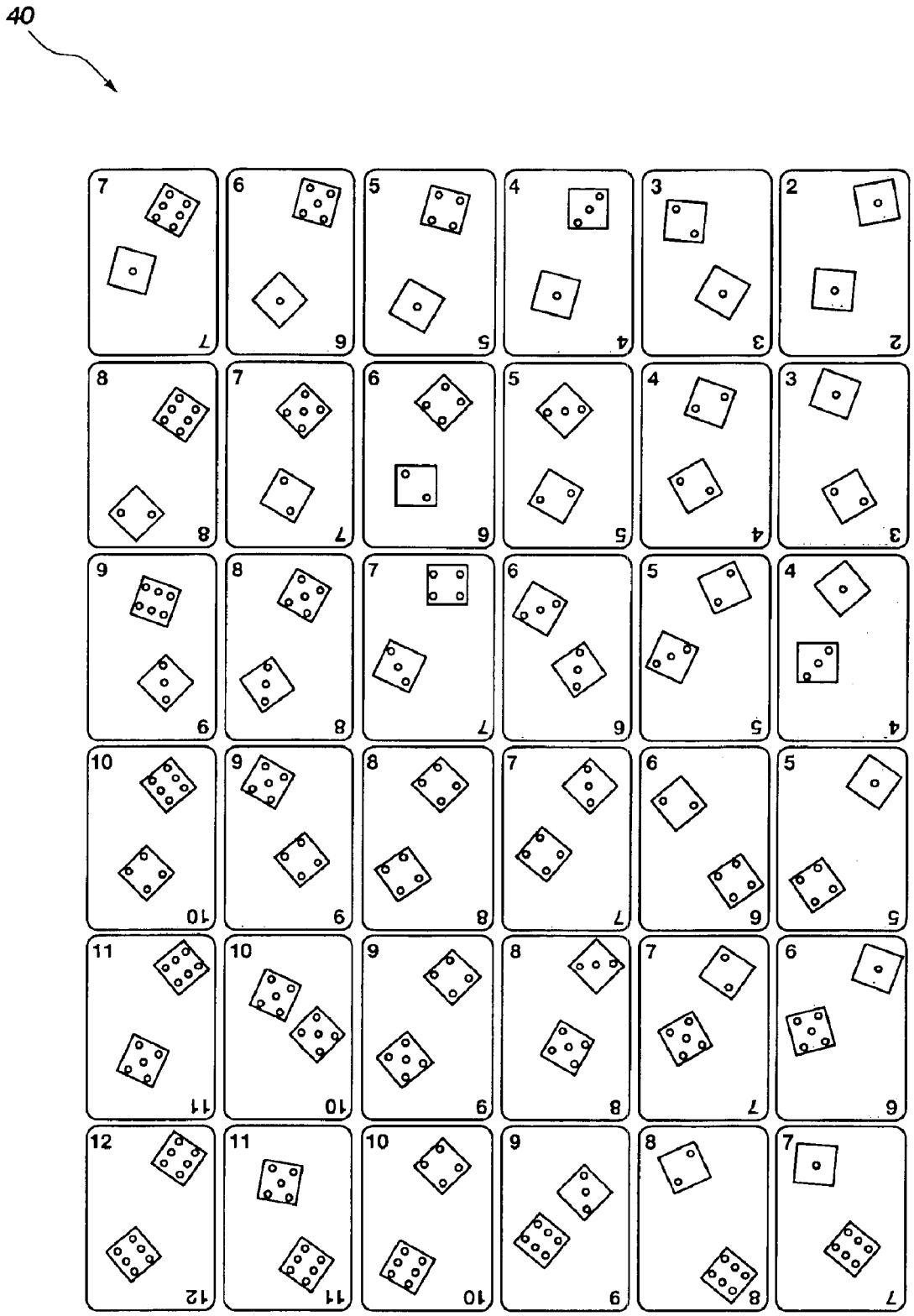
FIG. 5 depicts the cards used in the craps gaming system of FIG. 3.

Each card of the two decks 40 may have an indicia, or an image, of two dice and in combination, the thirty-six cards of each deck 40 may depict the 36 possible combinations of two six-sided dice being rolled. Referring to FIG. 5, there is illustrated one embodiment of the faces of the thirty-six cards that make up each deck 40 of the craps system 30. As illustrated, each card also includes the numeral of the spots of the combination of the two dice 36. In another exemplary embodiment, each card may only have the numeral of the 36 possible combinations and lack the die face images.

In yet another exemplary embodiment of the craps system 30, the dice 36R and 36B could be replaced by a random number generator. The random number generator could be configured to randomly determine which color, i.e., blue, red or any other type of indicia, that may be selected in order to select a play card from the boxes 34R or 34B.

Figure 6:
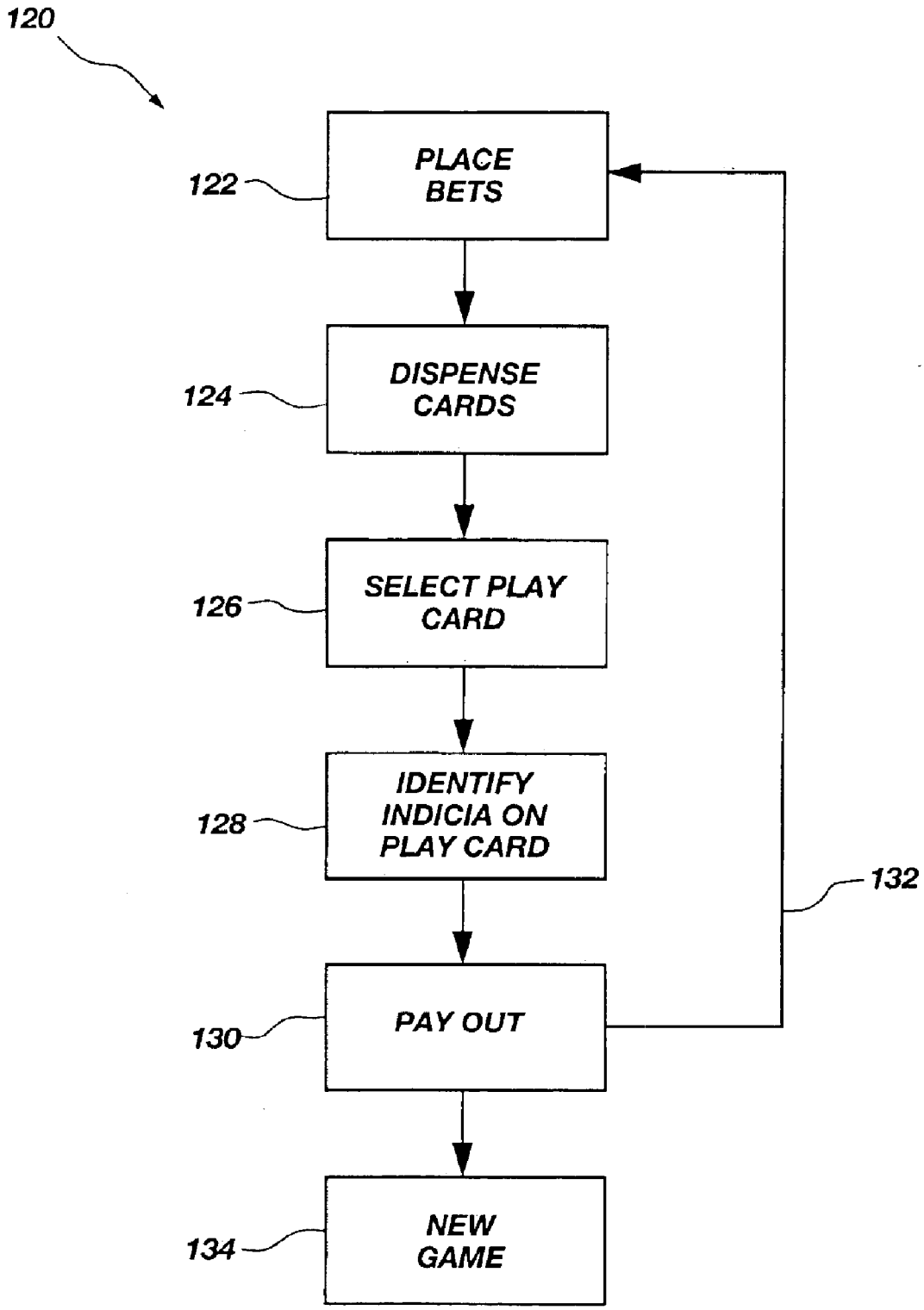
FIG. 6 illustrates a flowchart of the craps game played using the gaming system of FIG. 4.

Referring to FIG. 6, there is shown a flowchart of one embodiment of play of the craps game generally at 120. Play of the craps game using the craps system 30 is initiated when the players place bets on the craps table 32 by placing chip(s) on the indicia of the craps table 32 as per conventional craps betting procedures, indicated at dialog box 122. The bets include traditional bets and proposition bets. Once the bets are placed, the random card shuffler 38 may be used to shuffle the cards and randomly dispense at least two cards at box 124 that may be placed facedown in the boxes 34R and 34B. The remaining thirty-four cards may be automatically ejected from the random card shuffler 38 and placed into a discard holder (not shown). The random card shuffler 38 may be triggered to accept another thirty-six card deck 40 by the ejection. In another exemplary embodiment, a dealer may randomly shuffle and dispense the cards by hand.

One of the two cards in the boxes 34R and 34B is selected to be a play card at box 126. In the exemplary embodiment, the play card may be selected at box 126 by a stick man selecting a player to be a shooter, and giving the dice 36R and 36B to the shooter. The shooter shoots, or rolls, the dice 36R and 36B on the craps table 32. The color of the die 36R or 36B with the highest number determines which of the cards in the boxes 34R or 34B is turned over as the play card. The stickman announces the color of the die 36R (red) or 36B (blue) that has the higher number and identifies indicia of the play card by turning over the play card in the box 34R (red) or 34B (blue) corresponding to the color of the higher die 36R or 36B, as shown at box 128. The stickman may announce the indicia, or number, of the turned over play card. The dealers may then payout by taking, paying, or placing bets, as shown at box 130, which may occur per conventional Las Vegas Craps procedures.

As known in the art of craps, play of the craps game may continue as shown by arrow 132 (FIG. 6), or if play card indicates a point or craps, a new craps game may begin at box 134. The stickman may collect the two cards from boxes 34R and 34B and the thirty-four cards in the discard holder (or the random card shuffler 38 dispense rack) and place the cards into a receiving end of the random card shuffler 38 for the next round of play. In other exemplary embodiments, the play card may be selected from the boxes 34R or 34B using a random number generator, a random selection of a bingo-type ball, by allowing a player to choose one of the boxes 34R or 34B, by using a different number or types of dice, or with any other known selection technique.

If the play card is of a certain value, any players that wagered on the feature bet may be qualified for play of a feature game. The feature game may be played by turning over the second card to see if any players win the feature bet, which may be referred to as a "Super Prop Bet." In one feature bet, players wager that the two cards dispensed from the random card shuffler 38 at box 124 are the 2 and the 12. The dealer places the feature bet for the player by placing the player's chip(s) on the feature betting area 42. There is only one 2 card and only one 12 card in the 36-card deck 40. If the play card selected is the 2 or the 12, the dealer turns over the non-selected card after all action is finished for the play card. If the non-selected card is the 2 or the 12, the players making the feature wager are paid, otherwise the wagers are collected. The odds of the two and twelve being drawn together are 630-to-1 and, if the player wins the feature bet, the player is paid 500-to-1, giving the casino a theoretical advantage of about 20.5%. In the exemplary embodiment, indicia for the feature bet of the betting area 42 is placed on the craps table 32, such as near the top of the proposition bet section of the craps table 32.

The traditional craps bets include a player playing a Pass Line bet by placing chip(s) on the pass line. When a player plays the Pass Line, if the play card selected, or the come out play, is a 7 or 11 (natural), the players playing the Pass Line win, or if the first play card is a 2, 3 or 12 (craps), the Pass Line loses. Any other play card (4, 5, 6, 8, 9 or 10) becomes the point, and the dealer places the puck on the point number. Once the point is established, the Pass Line becomes a contract bet, meaning that all bets must remain on the craps table 32 and in action until the bets win or lose. Once the point is established, the shooter throws the dice and the stickman selects a play card at box 126 until a win or loss is achieved. The continued play is illustrated with arrow 132. The Pass Line wins if the play card matches the point before a 7 turns up as the play card, but loses if a 7 is made as the play card before the point. No other number, except the point or 7, affects the outcome of the Pass Line. Once the Pass Line wins or loses, the game begins again with a new come out play at box 134.

Another traditional bet is the Come Bet, which is substantially the same as the Pass Line bet, except the Come Bet is a new bet made once a pass line point is established. If the play card is a 7 or 11, new Come Bets win. If the play card is a 2, 3 or 12, new Come Bets lose. Any other play card becomes the point for the new Come Bets which the dealer will place on the point number. If this point is made before 7, those Come Bets win. However, if a 7 is made before the point, all Come Bets lose except for new ones that are coming out on that play.

A Don't Pass bet is the opposite of the Pass Line bet and is placed on the come out play. If the first selected play card is a 2 or 3, the Don't Pass bet wins. If the first selected play card is a 7 or 11, the Don't Pass bet loses, and 12 is a push, or tie. Any other card (4, 5, 6, 8, 9 or 10) becomes the point and the dealer places the puck on the point number. If a 7 comes up on the play card before the point, the Don't Pass bet wins. If the point number is made on the play card before a 7, the Don't Pass bet loses. However, unlike the Pass Line bet, the Don't Pass bet may be removed at any time.

A Don't Come bet is the same as the Don't Pass bet, but the Don't Come bet is a new bet after the Don't Pass point has been established. The Don't Come bet is essentially the opposite of the Come bet. If the play card is a 2 or 3, the Don't Come bet wins. If the play card is a 7 or 11, the Don't Come bet loses, and a 12 is a push or tie. Any other number (4, 5, 6, 8, 9 or 10) becomes the point for these bets and the dealer places the bet behind the number. If the play card is 7, all Don't Come bets behind the numbers win, but new Don't Come bets lose as the play card that is 7 is the come out card for the new bets. If the point number comes up before 7, the Don't Come bets behind the number lose. However, unlike Come Bets, the Don't Come bets may be taken down at any time as long as the player informs the dealer to do so.

In other traditional craps bets, a player may wager on a Place bet directly on any of the potential points numbers (4, 5, 6, 8, 9 or 10) at any time. With these Place bets, the dealer places all Place bets for the players. If the number placed appears before 7, the bet wins according to the odds for that number, which may be 9-to-5 for a play card of 4 or 10, 7-to-5 for a play card of 5 or 9, or 7-to-6 for a play card of 6 or 8. All Place bets lose on a 7 and may be removed at any time. Place bets that are marked off are out of action (cannot win or lose) until called on again. It is common for players to call their Place bets off on the come out play.

Another traditional craps bets is a Buy bet which is similar to a Place bet, but has slightly better odds. A player may wager that a Place bet on a play card of 4, 5, 6, 8, 9 or 10 will appear before a play card of 7 by informing the dealer which number(s) the player wishes to buy. Typically, there is a minimum amount of a bet required to wager on the Buy bet, such as twenty dollars. The player must pay a charge (vig) of 5% of the wager at the time the Buy bet is made. Buy bets pay true and correct odds such as 2-to-1 for a play card of 4 or 10, 3-to-2 for a play card of 5 or 9, or 5-to-6 for a play card of 6 or 8. The Buy bets may be made or taken down by the player at any time, and if the player takes down the Buy bet, the vig is also returned.

Other traditional craps bets may include Lay or Buy Behind bets, which are the opposite of Buy bets. A player may bet that a 7 will appear as the play card before a play card of a 4, 5, 6, 8, 9 or 10 by informing the dealer which number to Lay, or Buy Behind. The player must pay an added amount of five percent ("vig") of the potential win amount at the time the bet is made. Lay bets pay true and correct odds such as: 1-to-2 for a play card of 4 or 10, 2-to-3 for a play card of 5 or 9, or 5-to-6 for a play card of 6 or 8.

Players may place or take down Lay bets at any time, and if a player takes down a Lay bet, the vig is also returned.

Players playing Pass, Come, Don't Pass or Don't Come bets may also add to their existing bet once a point is established by making an additional bet called Odds. In the case of a pass line or come bet, the player may bet Odds that the point will be made before a 7 on the play card. In the case of a Don't Pass or Don't Come bet, the player may bet odds that a play card of 7 will occur before the point. The payoff odds are true and correct odds and vary from casino to casino.

In addition to traditional craps bets, the players may also make proposition bets. Proposition bets are high-odds bets located in the center of the craps table 32. The dealer places the proposition bets for the players and the payoff odds for the proposition bets are posted under the symbols for the proposition bets. Except for an All-Day Hard Way bet, all proposition bets are one-play bets.

One type of a proposition bet is a Horn bet that is a one-play bet made by a player that the play card will be a 2, 3, 11 or 12. The payoff odds will vary depending on which number comes up as the play card.

Another proposition bet is the All-Day Hard Way bet. There are four Hard Way combinations: hard 4 (2, 2); hard 6 (3, 3); hard 8 (4, 4); and hard 10 (5, 5). An All-Day Hard way bet is a wager that the double combination will occur before an Easy Way or a 7. The Easy Way includes all combinations of that number other than the Hard Way. For instance, the Hard Way to get a four is a play card with an indicia of 2 plus 2 as the dice, of which there is only one card in the deck as illustrated in FIG. 4, while the Easy Way to get a four includes play cards that have an indicia of 1 plus 3 or 3 plus 1, of which there are two cards in the deck as illustrated in FIG. 4. The payoff odds, which are typically posted underneath the bet, are slightly higher on hard 6 and 8 because there are fewer easy way combinations of 4 and 10. The Hard Ways bets remain in play until it wins, loses or is taken down by the player. Hard Ways bets may also be called off by the player, in which case the bet is out of action until it is called working, or on again. Many players will call the Hard Ways bets off on the come out play.

A Hopping Hard Ways bet is a one-play hard way bet. The players win according to the posted payoff, which are the same for 2 and 12, and lose on any other play card. A Hopping bet, which is also known as on the Hop, is another one-play bet that may be made on a specific combination of numbers on the play card for hands of 4 through 10 (excluding Hard Ways). Hopping bets pay the same as a 3 or 11.

In another exemplary embodiment, the craps system 30 may include one die 36 instead of two dice 36R and 36B, and three boxes 34 instead of two boxes 34R and 34B. In this exemplary embodiment, the one die 36 may be a six-sided die having three different indicia, such as numbers, each number being present on two faces of the die 36. For instance, the six-sided die could have two ones, two twos, and two threes, wherein the numbers correspond to the three boxes 34. During play, three cards are randomly dispensed at box 124 from the random card shuffler 38 and each card is placed face down in the three boxes 34. The play card is selected at box 126 when the dealer designates one player as the shooter and the shooter rolls the single die. The number that comes up on the die is used to determine which of the three boxes 34 is used to select the play card at box 126. The dealers pay out at box 130 by taking, paying, and placing bets according to the indicia depicted on the play card at box 128 according to the odds of the craps game, such as the odds of a conventional Nevada-style craps game. However, it will be apparent to those of ordinary skill in the art that the odds may vary since any number of dice or cards may be used in the craps system 30, and the odds may be adjusted to accommodate the different number of dice or cards.

While the roulette system 10 and the craps system 30 have been described herein as each using two card decks 20 and 40 and one random card shuffler 18 and 38, respectively, it will be apparent that any number of card decks 20 and 40 or random card shufflers 18 and 38 may be used. For instance, in order to speed up play of the roulette game or the craps game, in another exemplary embodiment, more than two card decks 20 and 40 and more than one random card shuffler 18 and 38 may be used. In other exemplary embodiments, the random card shuffler 18 and 38 may be configured to handle more than one card deck 20 and 40 at a time or instead of re-shuffling after each round of selecting a play card, more than one round of play cards may be selected before re-shuffling. In a further embodiment, more than one deck may be combined and randomly shuffled to select more than one round of play cards from the deck before re-shuffling.

In other exemplary embodiments, the craps game or the roulette game may be implemented on an electronic gaming machine, such as a video game or a video slot machine. As known by those of ordinary skill in the art, the electronic gaming machines may include various functional devices configured and programmed to simulate play of the craps game or the roulette game. For instance, the gaming machines may be configured with a microprocessor, a random number generator, a memory device, a video display, various input devices, sound generating devices, a coin or bill input for receiving money, a token input, a payout slot for payout bets and others. In yet a further embodiment, the craps game or the roulette game may be played in conjunction with electronic slot machines as an added or bonus game.

In yet other exemplary embodiments, a computer including a central processing unit may be configured to run software that executes play of the roulette game or the craps game described herein. The computer may be operatively connected via the internet to a server computer that is located at a location remote from the computer such that players may play a card-based roulette or craps game over the internet.

The exemplary embodiments described herein are not intended to limit the invention or the scope of the appended claims. Various combinations and modifications of the embodiments described herein may be made without departing from the scope of the present invention and all modifications are meant to be included within the scope of the present invention. For instance, the number of cards, decks of cards or dice, the odds of the payouts of the games, the number of random shufflers, the various indicia and identifying characteristics, may all be varied in the described gaming systems and still be encompassed by the present invention. Thus, while certain exemplary embodiments and details have been described for purposes of illustrating the invention, it will be apparent to those of ordinary skill in the art that various changes in the invention described herein may be made without departing from the scope of the present invention, which is defined in the appended claims.

What is claimed is:

1. A method of conducting a gaming activity, comprising:

providing a game table comprising a conventional craps layout having craps betting indicia thereon;

offering at least one player an opportunity to place at least one wager on at least one betting indicia on the game table, wherein the at least one wager may comprise a feature bet;

randomizing a deck of cards, each card of the deck having indicia representing a result from a roll of a pair of dice in a craps game, wherein all possible results from a roll of a pair of dice are represented in the deck of cards;

dispensing at least a first card and at least a second card from a deck of cards;

designating the at least a first card or the at least a second card as a play card; and identifying an indicia on the play card and comparing the identified indicia on the play card to the at least one betting indicia where the at least on wager was placed to determine an outcome of a craps game;

if the identified indicia on the play card comprises at least one first predetermined indicia, qualifying any player that wagered on the feature bet for participation in a feature game; wherein qualifying, comprises:

identifying an indicia on a non-designated card; and if the indicia on the non-designated card comprises at least one second predetermined indicia, awarding a feature bet payoff to the any player that wagered on the feature bet.

2. The method according to claim 1, where randomizing a deck of cards comprises shuffling the deck of cards with an automatic card shuffler.

3. The method according to claim 1, wherein designating the at least a first card or the at least a second card as the play card is effected by at least one of rolling a die, spinning a wheel, allowing a player to select the play card, selecting the play card with a random number generator, and selecting a ball from a group of balls.

4. A method of conducting a gaming activity, comprising:

providing a game table comprising a conventional roulette layout having roulette betting indicia thereon;

offering at least one player an opportunity to place at least one wager on at least one betting indicia on the roulette layout;

randomizing a deck of cards, each card of the deck having indicia representing a roulette betting indicia, wherein each betting indicia on a conventional roulette wheel is represented in the deck of cards;

dispensing at least two cards from the randomized deck of cards;

placing the at least two cards in separate areas, wherein each of the separate areas have separate indicia; wherein the indicia of at least one of the separate areas corresponds to the indicia of the pocket of a roulette wheel;

rotating the roulette wheel and dropping a ball onto the rotating roulette wheel, such that the ball is permitted to drop into a pocket of the roulette wheel;

designating at least one of the dispensed cards as a play card, wherein the designation is based on an indicia of the pocket of the roulette wheel wherein the ball drops; and identifying an indicia on the play card and comparing the identified indicia on the play card to the at least one betting indicia where the at least on wager was placed to determine an outcome of a roulette game.

5. The method according to claim 4, further comprising:

offering the at least one player an opportunity to place a feature bet on the roulette game, wherein the feature bet comprises;

designating at least one pocket of the roulette wheel as a feature pocket;

designating at least one card of the deck of cards as a feature card;

wherein the feature bet is awarded to the at least one player that places the feature bet if the ball drops into the feature pocket and the indicia on the play card identifies the play card as the feature card.

6. The method according to claim 4, wherein dispensing at least two cards from the randomized deck of cards comprises dispensing four cards from the randomized deck of cards.

7. The method according to claim 4, further comprising:

configuring the roulette wheel with thirty-eight pockets such that at least two of the pockets have separate identifying characteristics from the remaining pockets.

8. The method according to claim 4, wherein randomizing a deck of cards comprises shuffling the deck of cards with an automatic shuffler.

9. The method according to claim 4, wherein the indicia of the pocket is other than a number.

10. The method according to claim 4, wherein the at least two cards are dispensed from an automatic card shuffler.

11. A method of conducting a gaming activity, comprising:

providing a game table comprising a conventional craps layout having craps betting indicia thereon;

offering at least one player an opportunity to place at least one wager on at least one betting indicia on the craps layout;

randomizing a deck of cards, each card of the deck having indicia representing a result from a roll of a pair of dice in a craps game, wherein all possible results from a roll of a pair of dice are represented in the deck of cards;

dispensing at least a first card and at least a second card from a deck;

associating each dispensed card with an identifying characteristic;

rolling a first six-sided die having a first identifying characteristic and a second six sided die having a second identifying characteristic, the first six-sided die comprising a first distinguishing characteristic on three sides and a second distinguishing characteristic on three sides, and the second six-sided die comprising a third distinguishing characteristic on three sides and a fourth distinguishing characteristic on three sides;

comparing the distinguishing characteristics selected by rolling the first six-sided die and the second six-sided die to select either the first six-sided die or the second six-sided die;

comparing the identifying characteristic of the selected six-sided die to the identifying characteristic associated with the dispensed cards to designate the at least a first card or the at least a second card as a play card;

identifying an indicia on the play card; and determining an outcome of the craps game by comparing the identified indicia on the play card to the at least one betting indicia where the at least one wager was placed.

12. The method according to claim 11, wherein the at least a first card and the at least a second card are dispensed from an automatic card shuffler.

13. The method according to claim 12, where randomizing a deck of cards comprises shuffling the deck of cards with the automatic card shuffler.

14. The method according to claim 11, wherein the at least a first card and the at least a second card are dispensed from a deck of thirty-six cards.

15. The method according to claim 14, wherein the cards of the deck of thirty-six cards contain illustrations of each possible outcome when two standard dice are rolled.

16. The method according to claim 11, further comprising:

offering the at least one player an opportunity to place a wager on a feature bet, the feature bet comprising:

where the indicia of the play card comprises at least one first predetermined indicia, identifying an indicia on the at least a first card or the at least a second card not designated as the play card; and where the indicia of the at least a first card or the at least a second card not designated as the play card comprises at least one second predetermined indicia, awarding a feature bet payoff to any player that wagered on the feature bet.

17. The method according to claim 11, wherein the first identifying characteristic and the second identifying characteristic are each a different color.

18. The method according to claim 11, where associating each dispensed card with an identifying characteristic, comprises placing the at least a first card on a first area having an identifying characteristic that corresponds to the identifying characteristic of the first six-sided die; and placing the at least a second card on a second area having an identifying characteristic that corresponds to the identifying characteristics of the second six-sided die.

19. A system for conducting a roulette game comprising:

a table configured for accepting bets on the roulette game, wherein the table comprises a conventional roulette layout with roulette betting indicia thereon and at least one area for receiving a card, wherein the at least one area has an identifying characteristic;

at least one deck of cards, each card of the at least one deck having indicia representing a roulette betting indicia, wherein each betting indicia on a conventional roulette wheel is represented in the at least one deck of cards a roulette wheel comprising at least one pocket, wherein the at least one pocket is configured with an identifying characteristic that corresponds to the identifying characteristic of the at least one area for receiving a card;

a ball configured to fit in the at least one pocket;

an automatic card shuffler; and wherein the at least one packet, the identifying characteristic of the at least one pocket, the at least one area for receiving a card corresponding to the identifying characteristic, and the indicia on a card placed in the at least one area for receiving a card determines the outcome of a roulette game.

20. The system of claim 19, wherein the at least one pocket comprises thirty-eight pockets, wherein at least two pockets have at least two different identifying characteristics; and wherein the at least one area for receiving a card comprises at least two areas, wherein each of the at least two areas has an identifying characteristic that corresponds to one of the identifying characteristics of the at least two pockets.

21. The system of claim 20, wherein the thirty-eight pockets of the roulette wheel comprise twelve pockets having a first identifying characteristic, twelve pockets having a second identifying characteristic, twelve pockets having a third identifying characteristic, and two pockets having a fourth identifying characteristic.

22. The system of claim 20, wherein the at least two pockets comprise at least four pockets each having a different identifying characteristic and the at least two areas for receiving a card comprise at least four areas for receiving a card, each area for receiving a card having an identifying characteristic that corresponds to one of the different identifying characteristics of the at least four pockets.

23. The system of claim 19, wherein the at least one deck of cards comprises two decks of cards, wherein each deck of cards comprises thirty-eight cards.

24. The system of claim 19, wherein the identifying characteristic of the at least one pocket is other than a number.

25. A system for conducting a craps game comprising:

a table configured for accepting bets on the craps game, wherein the table comprises:

a conventional craps layout having craps betting indicia thereon;

at least two areas for receiving a card, wherein the each of the at least two areas includes a different identifying characteristic;

at least one deck of cards, each card of the at least one deck having indicia representing a result from a roll of a pair of dice in a craps game, wherein all possible results from a roll of a pair of dice are represented in the at least one deck of cards two six-sided dice comprising a first six-sided die having a first indicia on three sides and a second indicia on three sides, and a second six-sided die having a third indicia on three sides and fourth indicia on three sides, each having an identifying characteristic that corresponds to the different identifying characteristic of at least one of the at least two areas for receiving a card; and wherein an identifying characteristic of a selected six-sided die, the at least one area for receiving a card corresponding to the identifying characteristic, and the indicia on a card placed in the at least one area for receiving a card determines an outcome of a craps game.

26. The system of claim 25, wherein the at least one deck of cards comprises thirty-six cards, where each card depicts one of thirty-six possible outcomes from rolling two six-sided dice.

27. The system of claim 26, wherein the at least one deck of cards comprises two decks of cards.

28. The system of claim 25, further comprising an automatic card shuffler.

29. The system of claim 25, wherein the identifying characteristic is color.

* * * * *

UNITED STATES PATENT AND TRADEMARK OFFICE

CERTIFICATE OF CORRECTION

PATENT NO. : 7,165,769 B2
APPLICATION NO. : 10/641694
DATED : January 23, 2007
INVENTOR(S) : Crenshaw et al.

It is certified that error appears in the above-identified patent and that said Letters Patent is hereby corrected as shown below:

COLUMN 9, LINE 28, change "way" to --Way--

CLAIM 1 AT COLUMN 11, LINE 25, change "feature game; wherein" to --feature game, wherein--

CLAIM 4 AT COLUMN 11, LINES 54-59, change "indicia; wherein the indicia of at least one of the separate areas corresponds to the indicia of the pocket of a roulette wheel; rotating the roulette wheel" to -- indicia, wherein the separate indicia of at least one of the separate areas corresponds to an indicia of a pocket of a roulette wheel; rotating a roulette wheel--

CLAIM 19 AT COLUMN 13, LINE 53, change "packet" to --pocket--

Signed and Sealed this

First Day of May, 2007

JON W. DUDAS
*Director of the United States Patent and Trademark Office*